US008985195B2

(12) United States Patent
Wu

(10) Patent No.: US 8,985,195 B2
(45) Date of Patent: Mar. 24, 2015

(54) CONDENSING DEVICE AND THERMAL MODULE USING SAME

(75) Inventor: Chun-Ming Wu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 886 days.

(21) Appl. No.: 13/104,465

(22) Filed: May 10, 2011

(65) Prior Publication Data

US 2012/0285663 A1 Nov. 15, 2012

(51) Int. Cl.

| | |
|---|---|
| ***F28D 15/00*** | (2006.01) |
| ***F28D 15/02*** | (2006.01) |
| ***F28D 15/04*** | (2006.01) |
| *H05K 7/20* | (2006.01) |

(52) U.S. Cl.

CPC ..... *F28D 15/0266* (2013.01); *F28D 15/046* (2013.01)

USPC ..... 165/104.26; 165/104.21; 165/46

(58) Field of Classification Search

CPC ..... H01L 23/427; H01L 23/473; F28F 3/12; H05K 7/20318; H05K 7/20336; F28D 15/043; F28D 15/046; F28D 15/0266

USPC ..... 165/104.26, 104.33, 168, 170, 80.4, 165/146; 361/700; 257/715

See application file for complete search history.

(56) References Cited

U.S. PATENT DOCUMENTS

| | | | | |
|---|---|---|---|---|
| 3,640,090 | A * | 2/1972 | Ares | 62/436 |
| 4,120,351 | A * | 10/1978 | Kleine et al. | 165/170 |
| 5,422,787 | A * | 6/1995 | Gourdine | 361/697 |
| 6,019,165 | A * | 2/2000 | Batchelder | 165/80.3 |
| 6,223,810 | B1 * | 5/2001 | Chu et al. | 165/104.33 |
| 2006/0225867 | A1 * | 10/2006 | Park et al. | 165/80.4 |
| 2008/0078530 | A1 * | 4/2008 | Chang et al. | 165/104.26 |
| 2009/0084525 | A1 * | 4/2009 | Satou et al. | 165/104.21 |

* cited by examiner

*Primary Examiner* — Tho V Duong

(57) ABSTRACT

A condensing device and a thermal module using same are disclosed. The condensing device includes a hollow main body having a first inlet, a first outlet, and a flow-guiding zone. In the flow-guiding zone, there is provided a plurality of spaced flow-guiding members to define at least one flow passage therebetween. The at least one flow passage is communicable at two opposite ends with the first inlet and the first outlet. The thermal module is formed by connecting the first inlet and the first outlet of the condensing device to a second outlet and a second inlet of a heat-absorption unit, respectively, via two separate heat-transfer units. With the flow-guiding zone provided in the condensing device, it is able to accelerate the vapor-liquid circulation in the condensing device to thereby provide upgraded heat transfer efficiency.

4 Claims, 9 Drawing Sheets

CONDENSING DEVICE AND THERMAL MODULE USING SAME

FIELD OF THE INVENTION

The present invention relates to a condensing device, and more particularly to a condensing device enabling accelerated vapor-liquid circulation in a thermal module. The present invention also relates to a thermal module using the above-described condensing device.

BACKGROUND OF THE INVENTION

Due to the quick development in the electronic and semiconductor industrial fields, the progress in the process technology and the trends in market demands, various electronic devices have been designed to have compact volume and low weight. While the currently available electronic devices are gradually reduced in size, they actually have constantly increased functions and computing ability. For example, among other information electronic products, the most popular notebook computers and desktop computers all include many electronic components that generate heat during actual operation thereof. Particularly, the central processing unit (CPU) would generate the largest part of heat in the computer. Currently, a heat sink composed of radiating fins and a cooling fan is often used to provide heat dissipation function and plays an important role in protecting the CPU against accumulated heat, so that the CPU can be maintained at a normal working temperature to provide its intended functions. In brief, the CPU heat sink has become a highly important component in the present information electronic industry.

In recent years, water-cooling technique has been widely applied to personal computers for heat dissipation. With the water-cooling technique, the radiating fins occupying a large space are omitted, and heat generated by the heat source in an electronic system is collected by a working liquid; and then, a heat exchanger exchanges the collected heat with ambient air. Since the pipeline included in a water-cooling system for delivering the working liquid is length changeable according to actual need, the heat exchanger can be flexibly located at different places. That is, the heat exchanger, i.e. a radiating fin assembly, can be freely designed without being restricted by the space available for mounting it. However, the water-cooling system requires a pump for driving the working liquid to flow through the pipeline, and a water reservoir for storing the working liquid. Therefore, the water-cooling system is subject to some risks, such as the reliability of the pump and leakage of the pipeline.

Therefore, heat pipe is still the currently most frequently used technique in heat transfer, and radiating fins are still needed to exchange the heat transferred via the heat pipe with the ambient air. In some cases, the heat pipe and other heat dissipation elements are internally provided with a micro structure to enable increased heat dissipation efficiency. Meanwhile, other means are also tried to minimize the power consumption of the CPU in order to reduce the heat generated by the CPU.

FIG. 1 is a sectional view of a conventional loop-type thermal module 8. As shown, the thermal module 8 includes a heat-absorption element 81 having an outlet 811 and an inlet 812, and being filled with a working fluid 84; a condensing element 82 including a plurality of radiating fins 821; and a pipeline 83 connecting the condensing element 82 to the heat-absorption element 81 to form a heat-transfer loop.

The pipeline 83 includes a first section 831, a second section 832, and a third section 833. The first section 831 is extended between the outlet 811 of the heat-absorption element 81 and the condensing element 82; the second section 832 is bent to extend through the condensing element 82 several times; and the third section 833 is extended between the condensing element 832 and the inlet 812 of the heat-absorption element 81. It is noted the pipeline 83 including the first, second and third sections 831, 832, 833 is an integrally formed pipeline.

The heat-absorption element 81 is in contact with at least one heat-generating element 9 for absorbing heat generated by the element 9. The working fluid 84 in the heat-absorption element 81 is heated by the absorbed heat to change from liquid phase into vapor phase. The vapor-phase working fluid 84 flows out of the heat-absorption element 81 via the outlet 811 and flows through the first section 831 of the pipeline 83 to carry and transfer the absorbed heat to the condensing element 82. When the vapor-phase working fluid 84 flows through the second section 832 of the pipeline 83 that winds through the condensing element 82, the heat carried by the vapor-phase working fluid 84 is absorbed by the condensing element 82. The heat absorbed by the condensing element 82 is then radiated into the ambient air and dissipated, and the vapor-phase working fluid 84 flowed through the second section 832 is cooled and condensed into liquid phase again. The liquid-phase working fluid 84 keeps flowing through the second and the third section 832, 833 of the pipeline 83 back to the heat-absorption element 81 for the next cycle of vapor-liquid circulation.

After changing from vapor phase into liquid phase in the second section 832 of the pipeline 83, the working fluid 84 slowly flows back to the heat-absorption element 81 simply under the action of the gravity force. Thus, areas at middle, rear and bent portions of the second section 832 form ineffective areas that are little helpful in increasing the flow-back efficiency of the working fluid 84.

Therefore, the conventional thermal module 8 has the following disadvantages: (1) providing only low heat transfer effect; (2) forming areas of ineffective heat transfer; and (3) requiring high manufacturing cost.

SUMMARY OF THE INVENTION

A primary object of the present invention is to provide a condensing device enabling accelerated vapor-liquid circulation therein.

Another object of the present invention is to provide a thermal module that enables accelerated vapor-liquid circulation therein and eliminates areas of ineffective thermal convection.

To achieve the above and other objects, the condensing device according to the present invention includes a hollow main body having at least one first inlet, at least one first outlet, and a flow-guiding zone. The first inlet and the first outlet are arranged on the hollow main body corresponding two substantially diagonally opposite ends of the flow-guiding zone. In the flow-guiding zone, there is provided a plurality of spaced flow-guiding members, such that a flow passage is defined between any two adjacent flow-guiding members and at least one flow passage is formed in the flow-guiding zone; and the flow-guiding members respectively have an end directing toward the first inlet and another opposite end directing toward the first outlet.

To achieve the above and other objects, the thermal module according to the present invention includes a condensing device, at least one heat-absorption unit, a first heat-transfer unit, and a second heat-transfer unit. The condensing device includes a hollow main body having at least one first inlet, at least one first outlet, and a flow-guiding zone. The first inlet and the first outlet are arranged on the hollow main body correspondingly two substantially diagonally opposite ends of the flow-guiding zone. In the flow-guiding zone, there is provided a plurality of spaced flow-guiding members, such that a flow passage is defined between any two adjacent flow-guiding members and at least one flow passage is formed in the flow-guiding zone; and the flow-guiding members respectively have an end directing toward the first inlet and another opposite end directing toward the first outlet. The heat-absorption unit includes a vaporizing section being provided at two opposite ends with a second inlet and a second outlet. The second inlet is connected to the first outlet via the first heat-transfer unit, and the second outlet is connected to the first inlet via the second heat-transfer unit.

By providing the flow-guiding zone in the condensing device of the present invention, it is able to accelerate the vapor-liquid circulation in the condensing device and in the thermal module using the condensing device, and to avoid the problem of having areas of ineffective heat transfer.

In brief, the present invention has the following advantages: (1) eliminating areas of ineffective heat transfer; (2) accelerating vapor-liquid circulation; (3) largely upgrading the heat transfer efficiency; and (4) reducing the manufacturing cost thereof.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
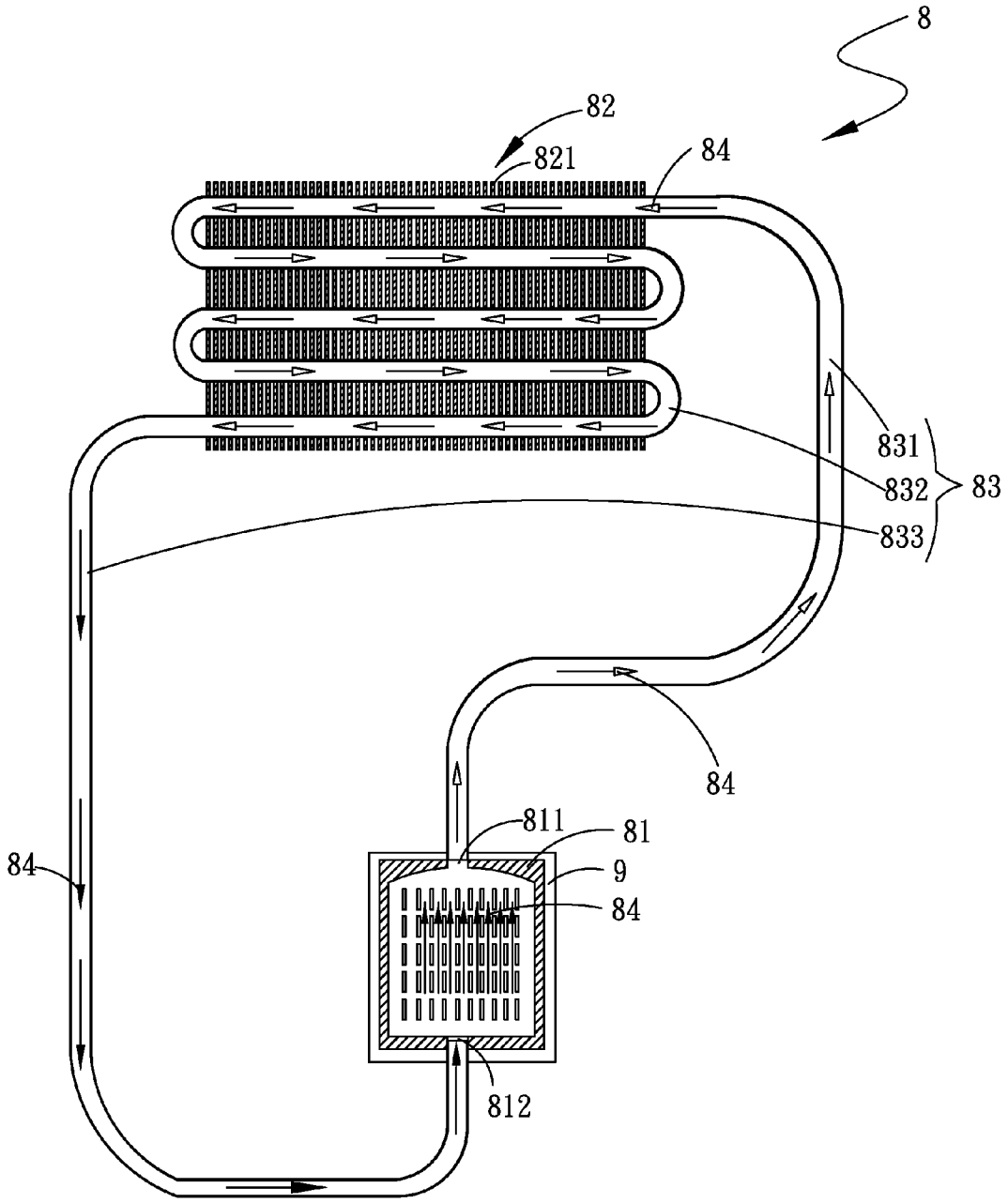
Fig. 1 (Prior Art)
FIG. 1 is a sectional view of a conventional thermal module.

The present invention will now be described with some preferred embodiments thereof and with reference to the accompanying drawings. For the purpose of easy to understand, elements that are the same in the preferred embodiments are denoted by the same reference numerals.

Figure 2:
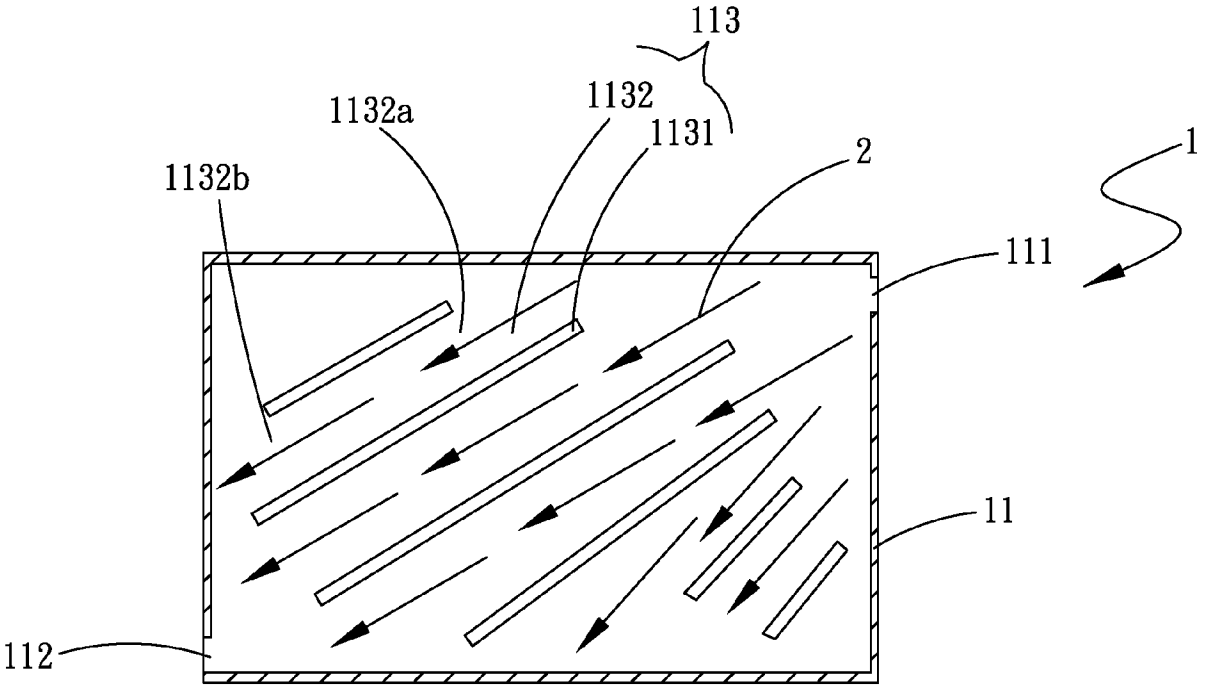
FIG. 2 is a sectional view of a first embodiment of a condensing device according to the present invention.

Please refer to FIG. 2 that shows a first embodiment of a condensing device 1 according to the present invention. As shown, the condensing device 1 includes a hollow main body 11.

The hollow main body 11 has at least one first inlet 111, at least one first outlet 112, and a flow-guiding zone 113. The first inlet 111 and the first outlet 112 are arranged on the hollow main body 11 correspondingly two substantially diagonally opposite ends of the flow-guiding zone 113. In the flow-guiding zone 113, there is provided a plurality of spaced flow-guiding members 1131, so that a flow passage 1132 is defined between any two adjacent flow-guiding members 1131 and at least one flow passage 1132 is formed in the flow-guiding zone 113. The flow-guiding members 1131 respectively have an end directing toward the first inlet 111 and another opposite end directing toward the first outlet 112.

The flow passages 1132 respectively have a first end 1132*a* and an opposite second end 1132*b*.

Figure 3:
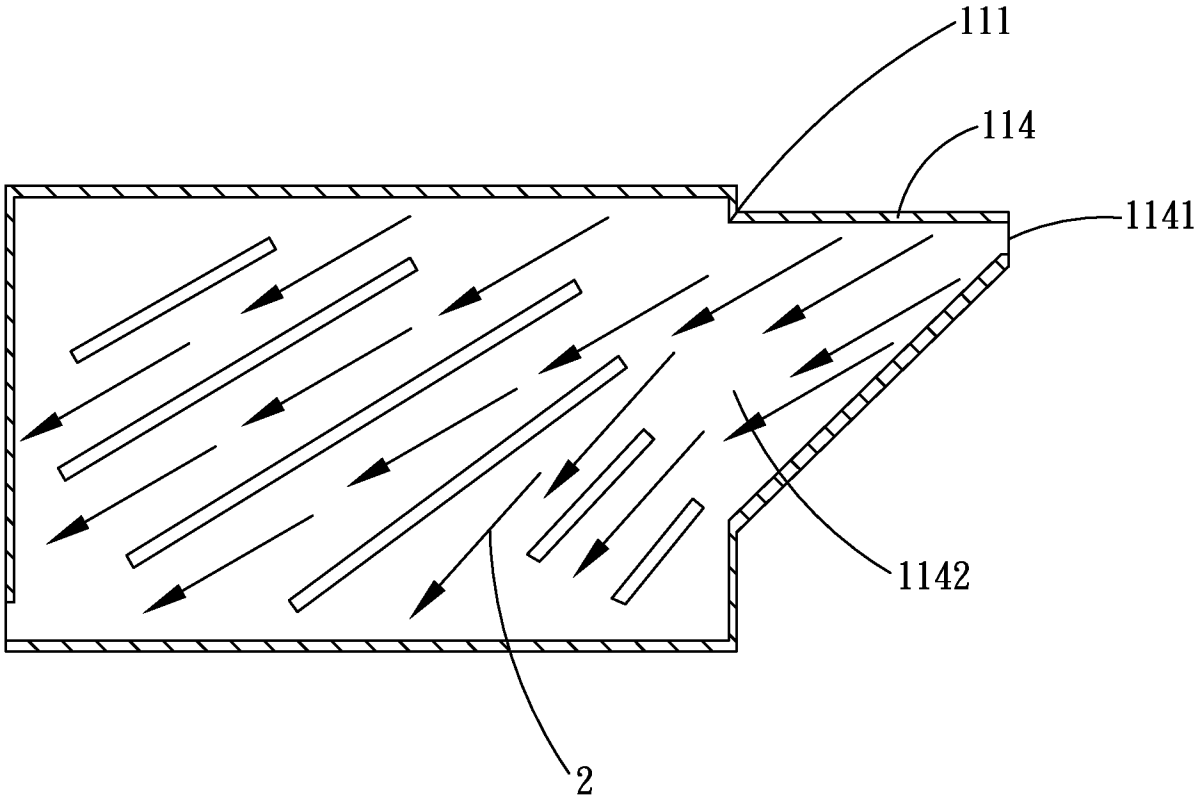
FIG. 3 is a sectional view of a second embodiment of the condensing device according to the present invention.

FIG. 3 is a sectional view of a second embodiment of the condensing device according to the present invention. As shown, the second embodiment is generally structurally similar to the first embodiment, except that, in the second embodiment, the hollow main body further includes an auxiliary diffusion section 114 outward projected from the first inlet 111. The auxiliary diffusion section 114 has an outer or first diffusion end 1141 and an inner or second diffusion end 1142. The first diffusion end 1141 has a size smaller than that of the second diffusion end 1142.

Figure 4:
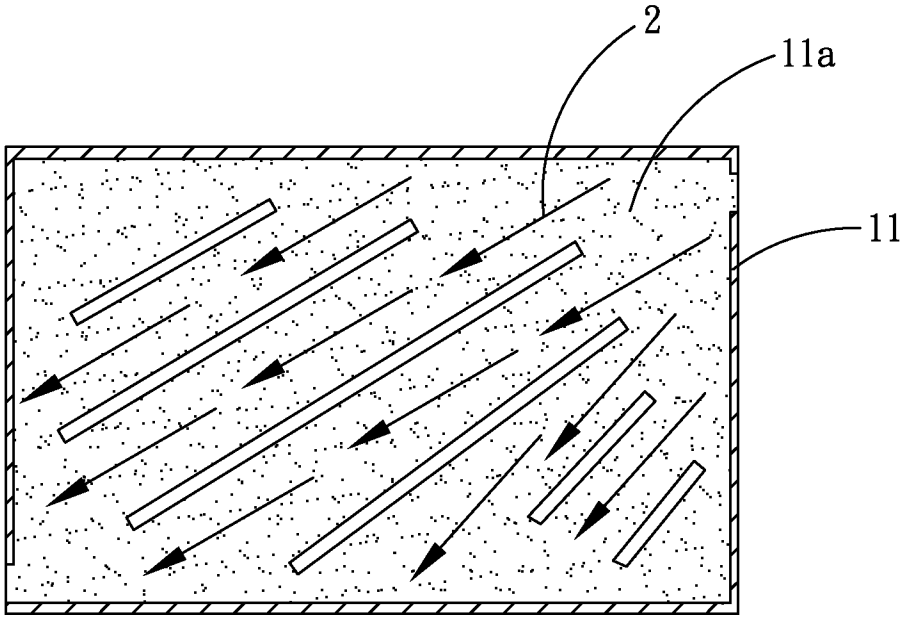
FIG. 4 is a sectional view of a third embodiment of the condensing device according to the present invention.

FIG. 4 is a sectional view of a third embodiment of the condensing device according to the present invention. As shown, the third embodiment is generally structurally similar to the first embodiment, except that, in the third embodiment, the hollow main body 11 is provided on inner wall surfaces with a wick structure 11*a*, which can be sintered metal powder or a net-like body. While the wick structure 11*a* for the third embodiment as illustrated in FIG. 4 is sintered metal powder, it is understood the wick structure 11*a* can be otherwise a net-like body.

Figure 5:
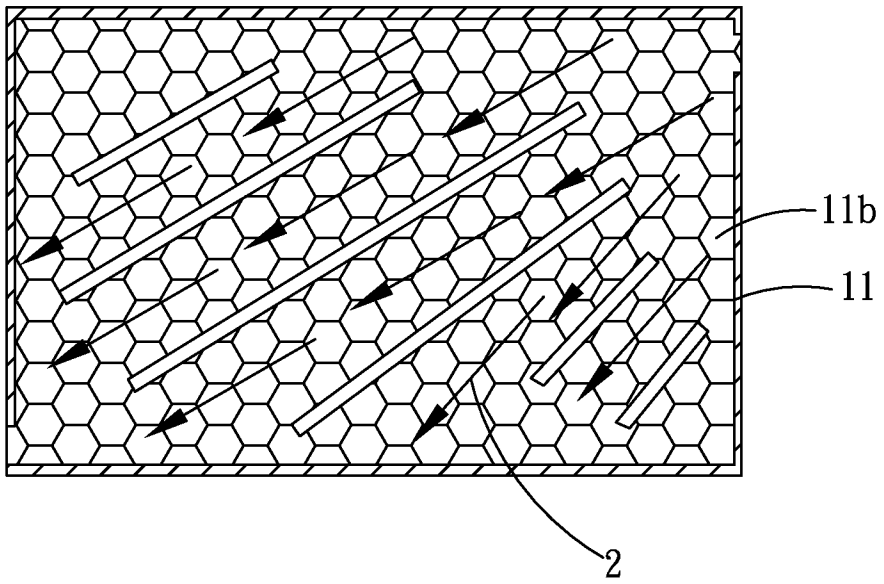
FIG. 5 is a sectional view of a fourth embodiment of the condensing device according to the present invention.

FIG. 5 is a sectional view of a fourth embodiment of the condensing device according to the present invention. As shown, the fourth embodiment is generally structurally similar to the first embodiment, except that, in the fourth embodiment, the hollow main body 11 is provided on inner wall surfaces with a plurality of grooves, dents or dots 11*b*. While the fourth embodiment illustrated in FIG. 5 is shown as having a plurality of dents 11*b* formed on the inner wall surfaces of the main body 11, it is understood the hollow main body 11 may be otherwise provided on the inner wall surfaces with grooves or dots.

Figure 6:
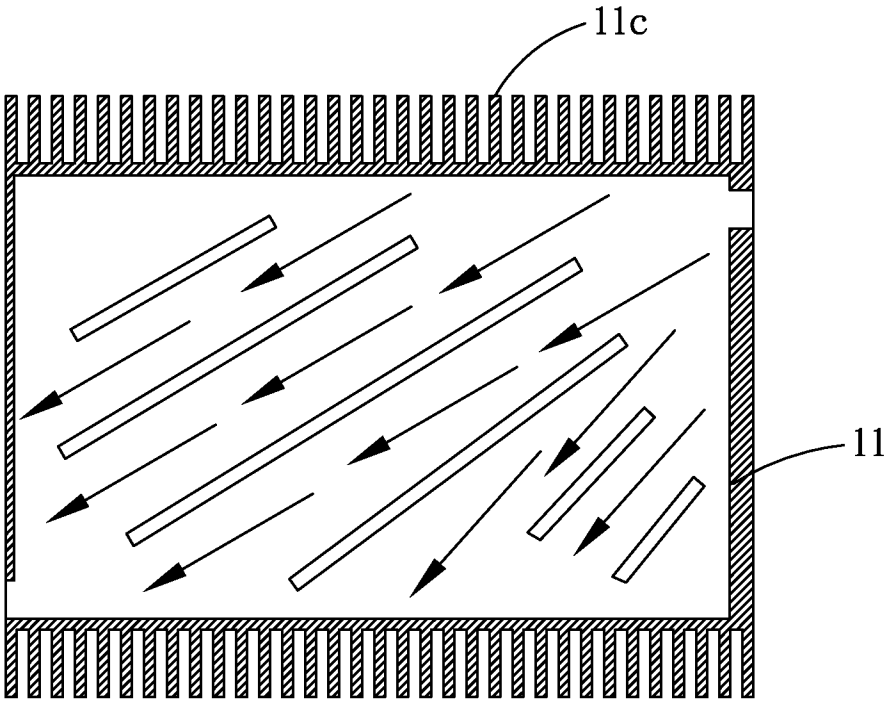
FIG. 6 is a sectional view of a fifth embodiment of the condensing device according to the present invention.

FIG. 6 is a sectional view of a fifth embodiment of the condensing device according to the present invention. As shown, the fifth embodiment is generally structurally similar to the first embodiment, except that, in the fifth embodiment, the hollow main body 11 is provided on outer wall surfaces with a plurality of radiating fins 11*c*.

All the above-described first to fifth embodiments of the condensing device according to the present invention have a working fluid 2 filled in the hollow main body 11. The working fluid 2 can be any type of coolant, such as purified water, methanol, acetone, or R134A.

Figure 7:
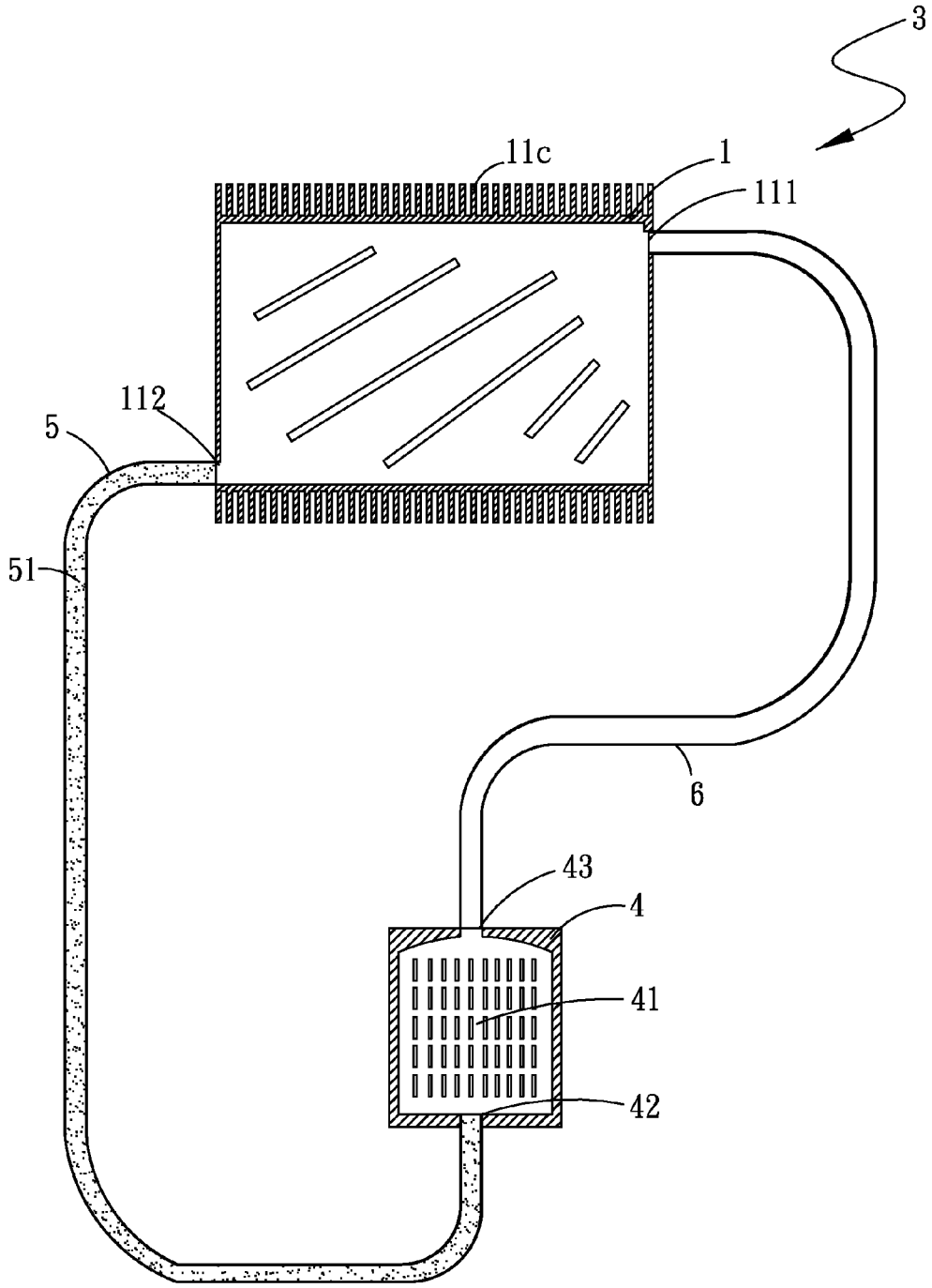
FIG. 7 is a sectional view of a first embodiment of a thermal module according to the present invention.

FIG. 7 is a sectional view of a first embodiment of a thermal module 3 according to the present invention. As shown, the thermal module 3 in the first embodiment thereof includes a condensing device 1, at least one heat-absorption unit 4, a first heat-transfer unit 5, and a second heat-transfer unit 6.

The condensing device 1 for the thermal module 3 is structurally similar to the first embodiment of the condensing device 1 according to the present invention. Please refer to FIGS. 2 and 7 at the same time. Since the condensing device 1 has been previously described with reference to FIG. 2, it is not repeatedly described herein.

The heat-absorption unit 4 includes a vaporizing section 41, a second inlet 42, and a second outlet 43. The second inlet and outlet 42, 43 are located at two opposite ends of the vaporizing section 41. The second inlet 42 is connected to the first outlet 112 via the first heat-transfer unit 5; and the second outlet 43 is connected to the first inlet 111 via the second heat-transfer unit 6.

The first heat-transfer unit 5 and the second heat-transfer unit 6 are hollow tubular members, and can be made of a metal material or a plastic material. In the illustrated first embodiment of the thermal module 3, the first heat-transfer unit 5 is a heat pipe without being limited thereto. The first heat-transfer unit 5 in the form of a heat pipe is provided on an inner wall surface with a wick structure 51 or a plurality of grooves. While the first heat-transfer unit 5 for the first embodiment of the thermal module 3 illustrated in FIG. 7 is shown as being internally provided with a wick structure 51, it is understood the first heat-transfer unit 5 can be otherwise provided on the inner wall surface with a plurality of grooves.

The condensing device 1 is provided on outer wall surfaces with a plurality of radiating fins 11*c*.

Figure 8:
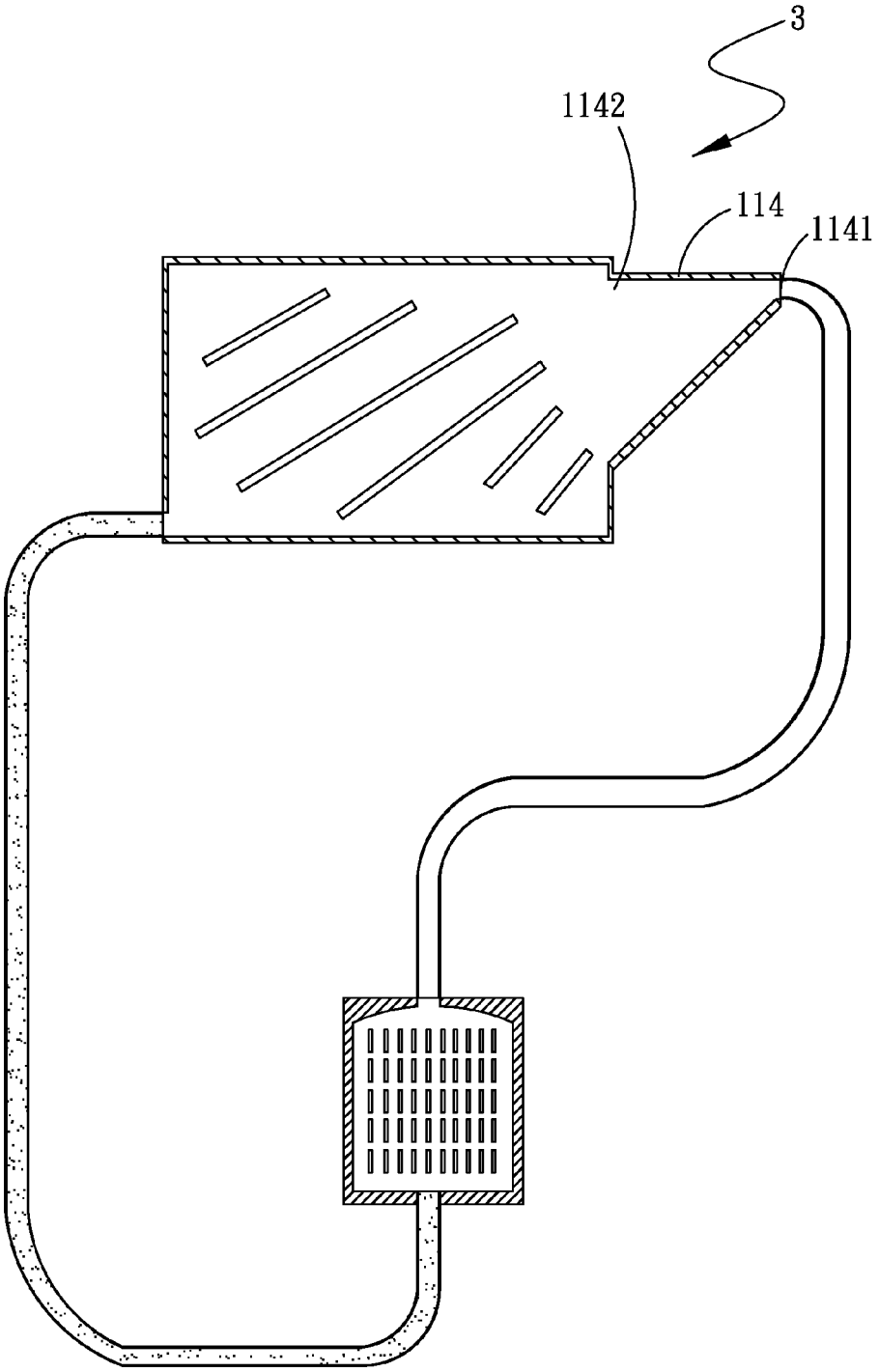
FIG. 8 is a sectional view of a second embodiment of the thermal module according to the present invention.

FIG. 8 is a sectional view of a second embodiment of the thermal module 3 according to the present invention. As shown, the thermal module 3 in the second embodiment is generally structurally similar to the first embodiment, except that, in the second embodiment, the condensing device 1 further includes an auxiliary diffusion section 114 outward projected from the first inlet 111. The auxiliary diffusion section 114 has an outer or first diffusion end 1141 and an inner or second diffusion end 1142, and the first diffusion end 1141 has a size smaller than that of the second diffusion end 1142.

Figure 9:
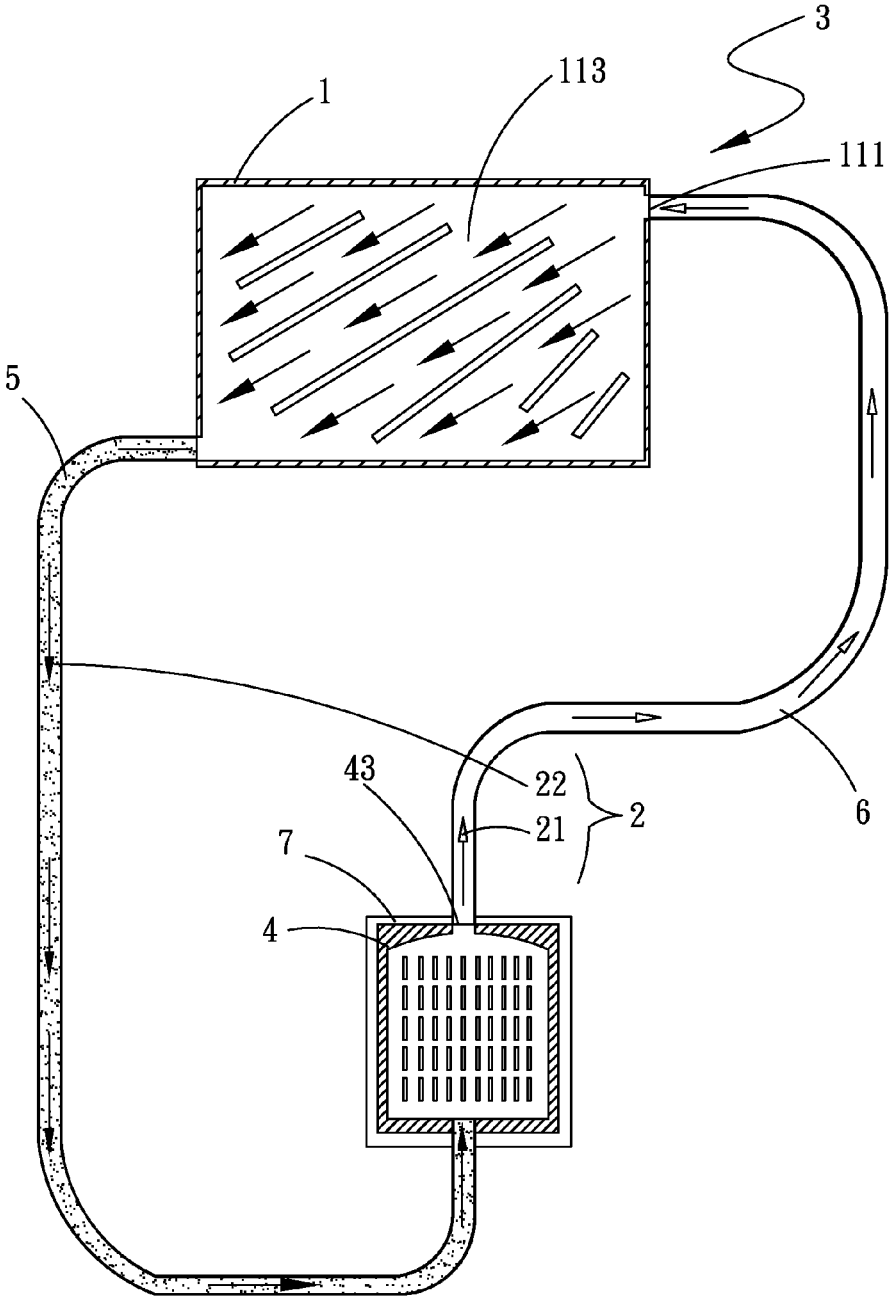
FIG. 9 shows the operation manner of the thermal module according to the present invention.

FIG. 9 shows the operating manner of the thermal module 3 according to the present invention. As shown, the heat-absorption unit 4 is in contact with at least one heat source 7 to absorb heat generated by the heat source 7. The working fluid 2 in the heat-absorption unit 4 is heated by the absorbed heat to change from a liquid-phase working fluid 22 into a vapor-phase working fluid 21 in the vaporizing section of the heat-absorption unit 4. The vapor-phase working fluid 21 flows out of the heat-absorption unit 4 via the second outlet 43 and flows through the second heat-transfer unit 6 into the condensing device 1 via the first inlet 111. With the high pressure produced by the flow-guiding zone 113 in the condensing device 1, and a low-pressure end created by an adequate pressure-relief design for the flow-guiding zone 113, it is able to from a pressure gradient in the condensing device 1 for accelerating the vapor-liquid circulation in the thermal module 3. The vapor-phase working fluid 21 flowing through the condensing device 1 is changed into the liquid-phase working fluid 22 again. Finally, the liquid-phase working fluid 22 flows through the first heat-transfer unit 5 back to the heat-absorption unit 4 to absorb heat generated by the heat source 7. With the above arrangements, the thermal module 3 according to the present invention can have increased heat transfer efficiency and overcome the problem of having areas of ineffective heat transfer as found in the conventional condensing device.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A thermal module, comprising:

a condensing device consisting of a hollow main body; the hollow main body having at least one first inlet, at least one first outlet, and a flow-guiding zone; the first inlet and the first outlet being arranged on the main body corresponding two substantially diagonally opposite ends of the flow-guiding zone; in the flow-guiding zone, there being provided a plurality of spaced flow-guiding members, such that a flow passage is defined between any two adjacent flow-guiding members and at least one flow passage is formed in the flow-guiding zone; and the flow-guiding members respectively having an end directing toward the first inlet and another opposite end directing toward the first outlet, wherein the hollow main body of the condensing device further includes an auxiliary diffusion section outward projected from the first inlet; the auxiliary diffusion section having an outer or first diffusion end and an inner or second diffusion end, and the first diffusion end having a size smaller than that of the second diffusion end;

at least one heat-absorption unit having a vaporizing section, the vaporizing section being provided at two opposite ends with a second inlet and a second outlet;

a first heat-transfer unit connecting the second inlet of the heat-absorption unit to the first outlet of the condensing device; and a second heat-transfer unit connecting the second outlet of the heat-absorption unit to the first inlet of the condensing device.

2. The thermal module as claimed in claim 1, wherein the at least one flow passage has a first end and a second end.

3. The thermal module as claimed in claim 1, wherein the hollow main body is filled with a working fluid, and the working fluid is selected from the group consisting of purified water, methanol, acetone, and R134A.

4. The thermal module as claimed in claim 1, wherein the heat-absorption unit is filled with a working fluid, and the working fluid is selected from the group consisting of purified water, methanol, acetone, and R134A.

* * * * *